US005364178A

United States Patent [19]

Hofman et al.

[11] Patent Number: 5,364,178

[45] Date of Patent: Nov. 15, 1994

[54] FILE CABINET HAVING A CORREGATED INNER FRAMEWORK CONSTRUCTION

[75] Inventors: William K. Hofman, Coopersville; Jerry J. Mayette, Muskegon; David F. Bach, Walker, all of Mich.

[73] Assignee: Westinghouse Electric Corporation, Pittsburgh, Pa.

[21] Appl. No.: 872,476

[22] Filed: Apr. 23, 1992

[51] Int. Cl.[5] ..... A47B 47/00

[52] U.S. Cl. ..... 312/263; 220/408; 312/265.5

[58] Field of Search ..... 312/263, 264, 265.5, 312/265.4, 257.1, 404, 406, 408; 220/408

[56] References Cited

U.S. PATENT DOCUMENTS

| | | | |
|---|---|---|---|
| 1,046,488 | 12/1912 | Pauley | 312/257.1 X |
| 1,729,475 | 9/1929 | Brainard et al. . | |
| 2,072,446 | 3/1937 | Forsthoefel | 312/408 X |
| 2,112,498 | 3/1938 | Lax | 312/263 X |
| 2,127,212 | 8/1938 | Geddes | 312/404 |
| 2,620,251 | 12/1952 | Restivo . | |
| 2,704,237 | 3/1955 | Nave | 312/404 |
| 2,959,715 | 11/1960 | Leonchick | 312/257.1 X |
| 3,272,581 | 9/1966 | Stucki . | |
| 3,285,684 | 11/1966 | Duncan . | |
| 3,410,621 | 11/1968 | Schreyer . | |
| 3,623,784 | 11/1971 | Newfeld . | |
| 3,779,623 | 12/1973 | Motohashi | 312/257.1 |
| 3,810,430 | 5/1974 | Siegal | 312/264 X |
| 3,870,388 | 3/1975 | Löfgren | 312/264 X |
| 3,995,922 | 12/1976 | Ohashi | 312/265.5 |
| 4,005,919 | 2/1977 | Hoge et al. | 312/406 |
| 4,114,065 | 9/1978 | Horvay | 312/406 |
| 4,303,286 | 12/1981 | McClellan | 312/184 X |
| 4,378,137 | 3/1983 | Gibson et al. | 312/257 R |
| 4,782,972 | 11/1988 | Wenkman et al. | 312/263 X |
| 4,822,117 | 4/1989 | Boston, Jr. | 312/257.1 |
| 5,031,974 | 7/1991 | Feucht et al. | 312/263 |
| 5,102,210 | 4/1992 | Beals | 312/330.1 |
| 5,221,136 | 6/1993 | Hauck et al. | 312/406 |
| 5,238,137 | 8/1993 | Cornwall | 220/408 X |
| 5,246,286 | 9/1993 | Huebschen et al. | 312/263 |

FOREIGN PATENT DOCUMENTS

| | | | |
|---|---|---|---|
| 167306 | 3/1956 | Australia | 312/263 |
| 2365310 | 5/1978 | France | 312/265.5 |
| 607016 | 7/1960 | Italy | 312/265.5 |
| 50454 | 5/1941 | Netherlands | 220/408 |
| 88473 | 10/1956 | Norway | 312/406 |
| 159299 | 6/1957 | Sweden | 312/406 |
| 0214601 | 8/1967 | Sweden | 312/408 |
| 151257 | 2/1932 | Switzerland . | |
| 178984 | 5/1922 | United Kingdom . | |
| 840855 | 7/1960 | United Kingdom | 312/408 |
| 0960363 | 6/1963 | United Kingdom | 312/265.5 |
| 988296 | 4/1965 | United Kingdom | 312/406 |

*Primary Examiner*—Lloyd A. Gall
*Attorney, Agent, or Firm*—Carla J. Vrsansky

[57] ABSTRACT

A metal case having an adaptable capability between a lateral file or a cabinet which includes an inner framework comprised of a plurality of corrugated metal panels, each having a similar cross-sectional configuration and substantially extending the depth and length of the case. The panels are arranged horizontally and vertically to form a box-like structure which may be encased in a one-piece, metal outer wrapper and finished with a top and a base pan, thereby concealing spot welds which partially secure the inner framework to the outer wrapper. The inner framework is further secured to the outer wrapper by adhesive, which also provides acoustical insulation.

11 Claims, 11 Drawing Sheets

FILE CABINET HAVING A CORREGATED INNER FRAMEWORK CONSTRUCTION

BACKGROUND OF THE INVENTION

1. Field of the Invention

This invention relates to a metal case and, more particularly to a metal case adaptable to a lateral file or a cabinet having an inner framework including a plurality of corrugated panels that extend substantially the complete depth and length of the case and are arranged to form a box-like structure which may be encased in a one-piece outer wrapper, thereby providing a sturdy, solid, cost effective case construction.

2. Description of the Related Art

Modern office or industrial environments require increasing storage capabilities including storage cabinets and lateral filing systems that can be multi-functional, easily interchangeable and sturdy, but also attractive and inexpensive in order to adapt to the many styles of office design.

Metal cases including storage cabinets, filing cabinets and the like are well known in the art. Most are constructed having an inner skeleton and an outer skin which can be inexpensively produced but which possess a tinny, hollow sound as drawers or cabinet doors are opened or closed. The exterior of these cabinets also exhibit unsightly spot weld blemishes and austere, industrial designs. With the increasing need and desire for attractive, executive offices, these ordinary metal cabinets look more at home in a warehouse or on a shop floor rather than in a plush office setting.

As previously mentioned, many storage and filling cabinets are constructed using an interior skeleton frame including vertical rails or channels and horizontal cross bars. However, these interior skeleton frames, which support only an exterior skin, do not provide sufficient sturdiness to prevent a tinny, hollow sound when drawers or cabinet doors are opened or closed.

Other cabinets, particularly wood kitchen cabinets, include interior vertical partition walls having apertures to accommodate shelf brackets. While metal office cabinets generally do not include interior partition walls which could provide more structural stability, there have been instances of lateral filing cabinets which include an inner side panel construction with flanged side edges which attempt to solve the sturdiness problem, but which are more costly to manufacture because of the increased need for additional thicker gauged metal to provide a double wall construction.

Unsightly spot weld blemishes on the exterior of office cabinets also detract from the desired attractive appearance of modern office settings. There have been attempts to conceal these blemishes, but these attempts have resulted in excess use of hardware and unattractive interiors of cabinets. For example, some cabinets include interior intersecting panels with intersecting flanges which are internally connected by screws to conceal exterior spot weld blemishes. However, excess hardware is required and the screws can be easily misplaced.

Furthermore, there have been attempts to provide good sound deadening properties within storage cabinets by use of mastic or adhesive whereby the top of the cabinet is secured. However, these cabinets have not utilized adhesive in a double supporting wall construction of a metal cabinet which would provide sound deadening properties as well as conceal unsightly spot-weld attachments.

Consequently, there exists a need to provide high quality metal cabinets and lateral files adaptable to various office settings and uses that are attractive, cost effective, sturdy and solid, that do not produce tinny, hollow sounds when drawers or cabinet doors are opened or closed and that do not require excess hardware or parts that can be easily misplaced.

SUMMARY OF THE INVENTION

A metal case having an adaptable capability between a lateral file and a cabinet which includes an inner framework comprised of a plurality of corrugated metal panels, each having a similar cross-sectional configuration and substantially extending the complete depth and length of the case. The panels are arranged horizontally and vertically to form a box-like structure which is encased in a one-piece, metal outer wrapper and finished with a top and a base pan, thereby concealing spot welds which partially secure the inner framework to the outer wrapper. The inner framework is further secured to the outer wrapper by adhesive, which also provides acoustical insulation.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

FIG. 9 is a perspective view of the upper left-hand corner of the inner framework illustrating the way in which the top panel and the left side panel are arranged and secured;

DESCRIPTION OF THE PREFERRED EMBODIMENT

The metal case described herein is capable of being adapted to a cabinet or a lateral file which includes an inner box-shaped framework constructed of similarly configured metal corrugated panels which substantially extend the complete depth and length of a side of the case. The inner framework may be encased in a one-piece metal outer wrapper as well as a top and bottom pan, thereby providing a double wall thickness of the entire top, sides and bottom of the metal case.

Figure 1:
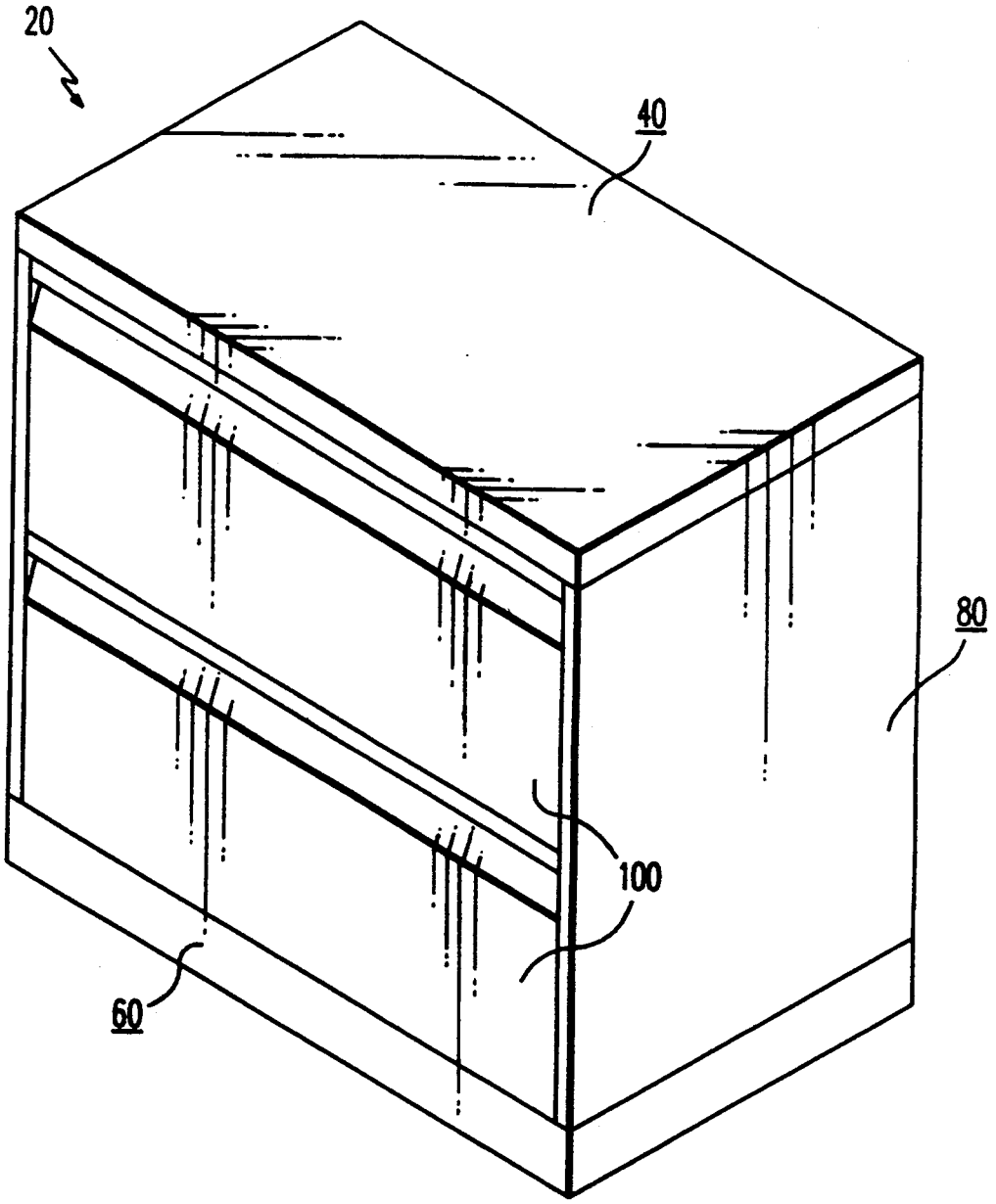
FIG. 1 is a perspective view of the exterior of the metal case, in this instance, a lateral file with drawers.
Figure 2:
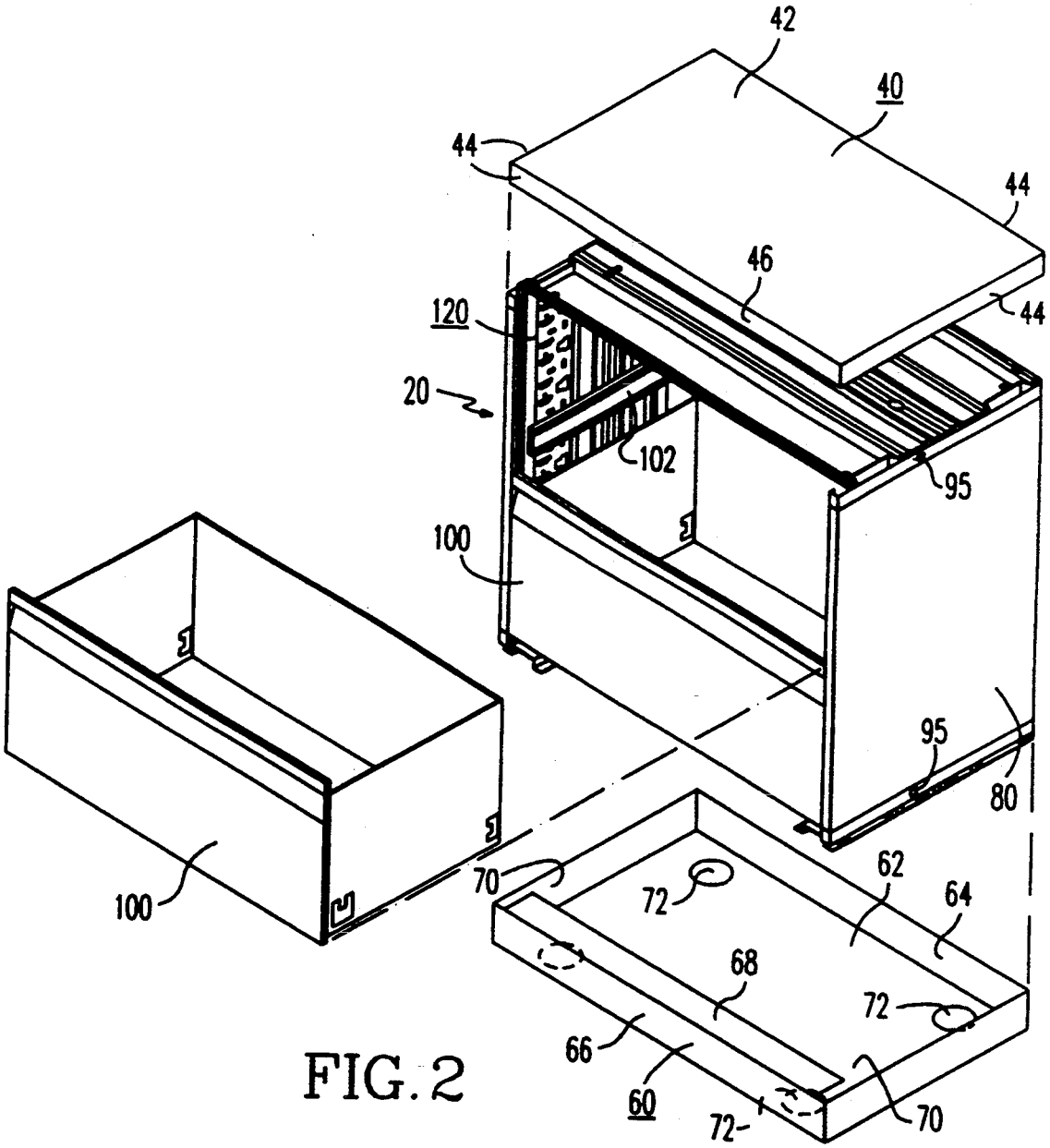
FIG. 2 is a partially exploded perspective view of the case illustrating the outer wrapper attached to the inner framework with the top pan, bottom pan, and one of the drawers exploded away for clarity.
Figure 3:
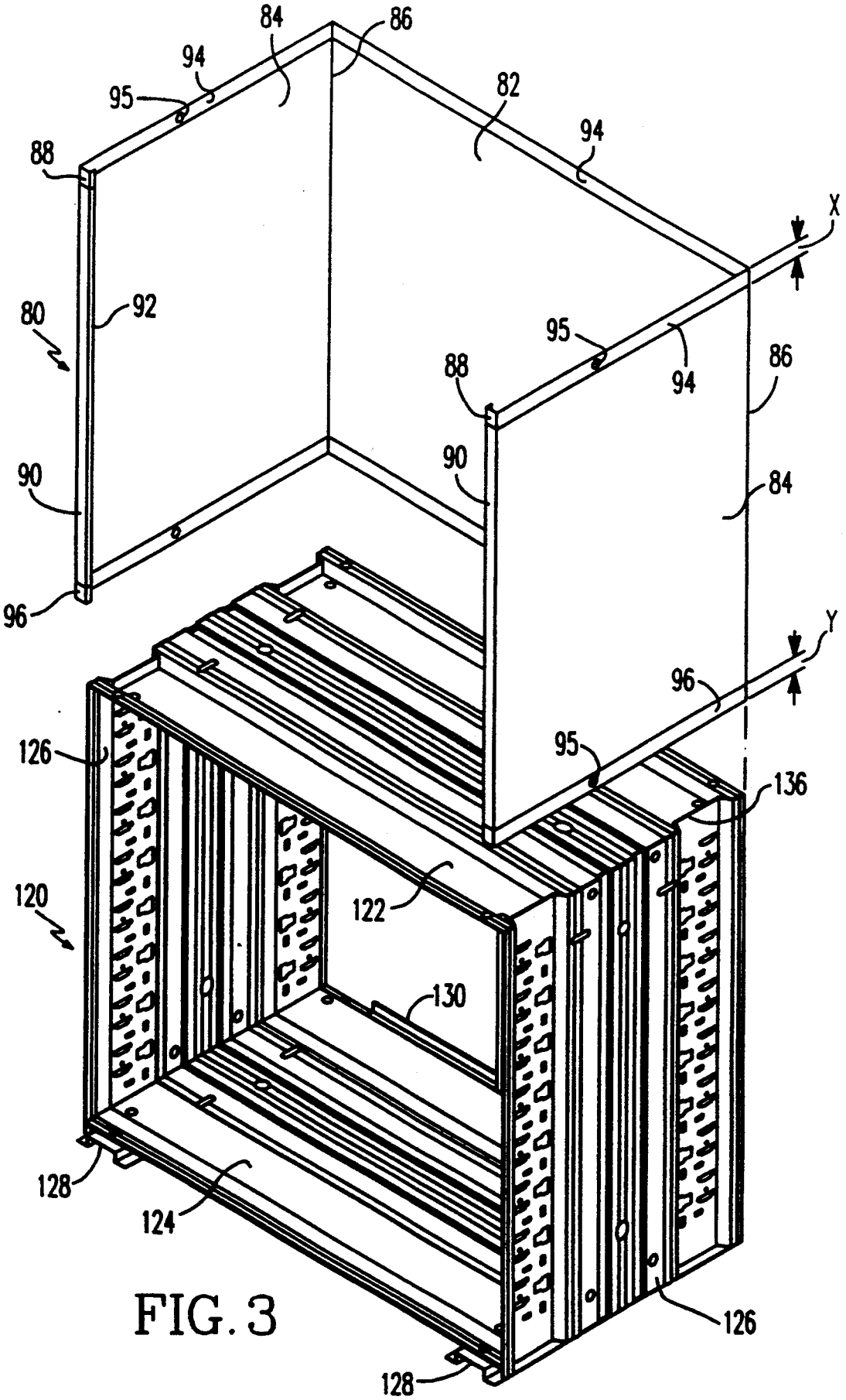
FIG. 3 is a partially exploded perspective view of the case illustrating the outer wrapper exploded away from the inner framework.
Figure 4:
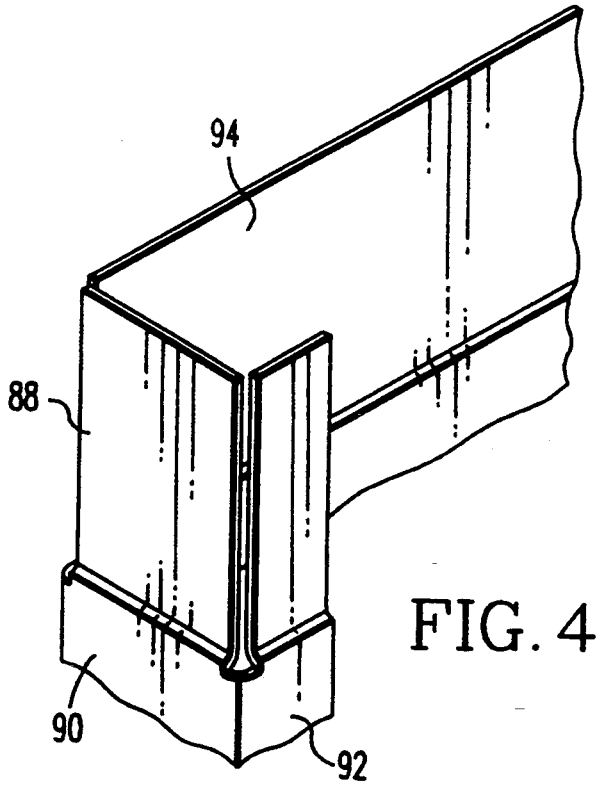
FIG. 4 is a perspective view of a corner of the upper ledge of the outer wrapper.
Figure 6:
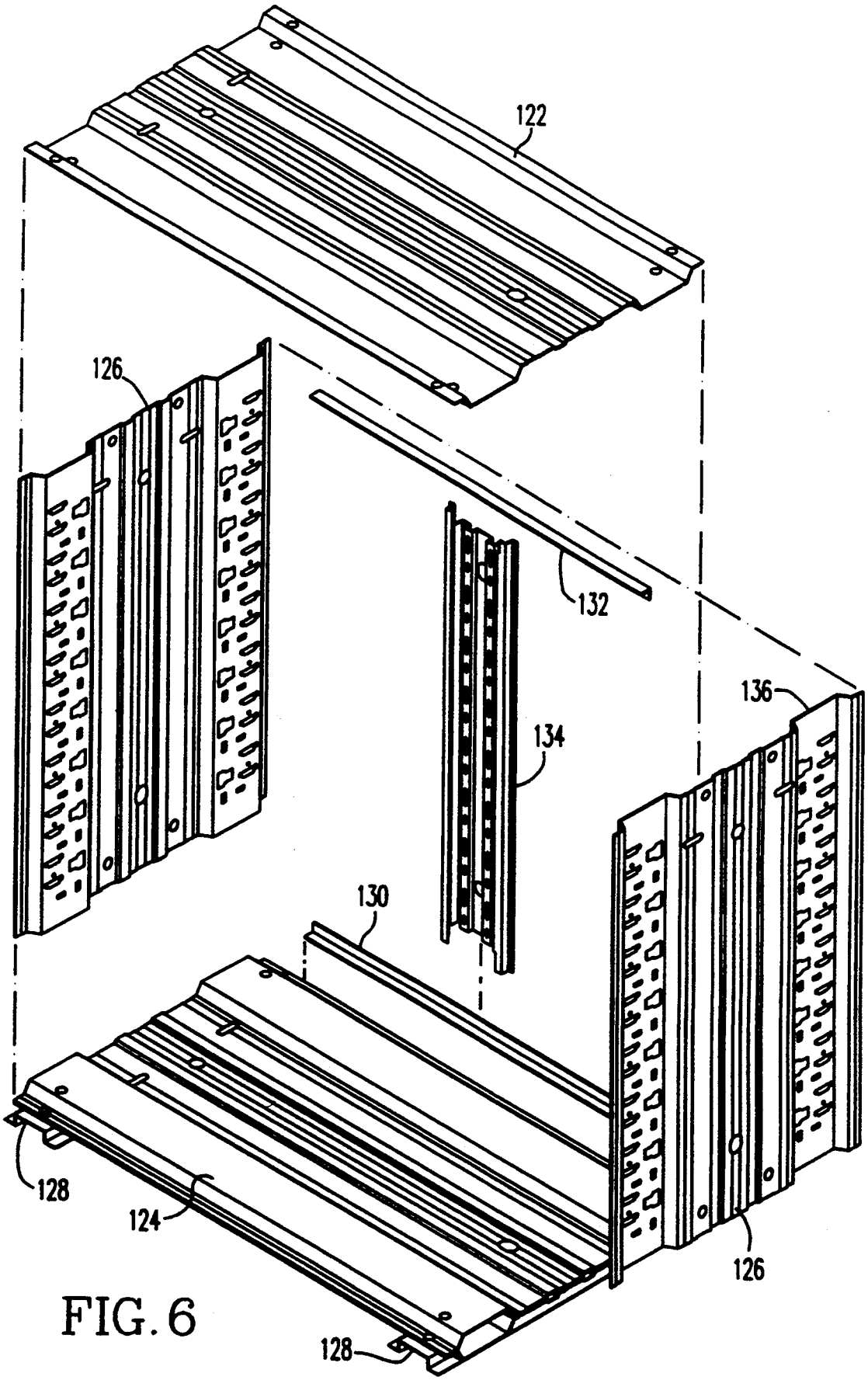
FIG. 6 is an exploded perspective view of the inner framework of the case.

Referring now in detail to the drawings wherein like reference characters represent like parts throughout the several views, there is illustrated in FIG. 1 a lateral filing cabinet which is one embodiment of the metal case referred to in this specification. The metal case 20 includes a top pan 40, a base pan 60, an outer wrapper 80, and in this instance, drawers 100. FIGS. 2, 3 and 6 illustrate various exploded views of the metal case 20 in order to clearly demonstrate the major components and construction of the case.

FIG. 2 illustrates the metal case 20 with top pan 40, base pan 60, and one of the drawers 100 exploded in order to show a portion of the inner framework 120. Further illustrated in FIG. 2 is a drawer glide 102 which is easily snapped into the inner framework 120 in order to accommodate drawers 100.

The top pan 40 is formed from a single sheet of metal which may be 22 gauge steel and includes a top 42 and four shallow sides 44, each of which are substantially perpendicular to each other and to top 42, thereby resembling the lid of a box. The front side edge 46 of top pan 40 includes an inner lip or reveal (not shown), which is bent inwardly perpendicular to front side edge 46 and parallel to top 42.

Base pan 60 is also formed from a single sheet of 22 gauge sheet metal and may be similar in appearance to top pan 40. Base pan 60 may vary in height to accommodate the customer's needs. Base pan 60 includes a bottom 62 and four sides 64, each of which are substantially perpendicular to each other and to bottom 62. Front side edge 66 of base pan 60 further includes an inner lip or reveal 68, which is bent inwardly perpendicular to front side edge 66 and parallel to bottom 62. Inner lip 68 may not extend the entire length of front side edge 66, thereby defining spaces 70 on either end of lip 68. Base pan 60 further includes four apertures 72 which may be located in the four outer corners of bottom 62 of base pan 60.

The seamless outer wrapper 80, more fully illustrated in FIGS. 2, 3, 4 and 5 comprises a single sheet of metal such as 22 gauge steel and formed to define a three-sided, generally C-shaped surfaced including a back wall 82 and two side walls 84. Side walls 84 extend substantially perpendicularly from either end 86 of back wall 82 and terminate in U-shaped bends 88. Each U-shaped bend 88 is defined by a bend 90 perpendicular to side wall 84 and an inward bend 92 parallel to side wall 84. Outer wrapper 80 further includes an upper ledge 94 and a lower ledge 96. Upper ledge 94 and lower ledge 96 are roll formed in the sheet metal comprising outer wrapper 80 as an upper and lower indentation which may extend substantially the entire perimeter of the outer wrapper 80. Upper ledge 94 and lower ledge 96 include openings 95 which aid in alignment of the outer wrapper 80 when being assembled to the case 20. Upper ledge 94 measures approximately one inch as indicated by the line x, which corresponds to the length of the sides 42 of top pan 40. Likewise, lower ledge 96 measures approximately one inch as indicated by the line y, which corresponds to the length of the sides 64 of base pan 60. The measurement of lower ledge.96 may vary depending on the height of the base pan 60 requested by consumers. Therefore, when metal case 20 is assembled, which will be described in greater detail later in the specification, top pan 40, which is placed over the top of the case, fits snugly over upper ledge 94 and base pan 60, which covers the bottom of the case, fits snugly over the lower ledge 96.

Still referring to FIG. 3 and in addition to FIG. 6, the inner framework 120 which resembles a box is comprised of a top panel 122, a bottom panel 124, which is actually two top panels 122 placed back-to-back and welded together, and two side panels 126. Each panel may have substantially the same configuration, thereby providing for ease of production and assembly. Furthermore, the similar configuration is readily adaptable to mass production. The dimensions of each panel correspond to the dimensions of the case, for example, top panel 122 may extend substantially the entire length and depth of the top of metal case 20, side panels 126 may extend substantially the entire depth and height of metal case 20 and so on thereby creating a "box within a box." Therefore, the inner framework provides a stronger frame which does not rely on the outer housing for the structural integrity of the metal case.

Top panel 122, each portion of bottom panel 124 and side panels 126 may be roll formed 20 gauge steel. As can be seen from the drawings these panels may have substantially the same thickness and cross-section so that they may be produced from the same stock. The panels may be joined to the adjacent panel by welding at various points along their adjoining edges.

Referring to FIG. 6, a rail 128 may be attached by welding to each end of the bottom of bottom panel 124 thereby providing a base or feet to metal case 20. A first attachment strip 130 may be welded to the back portion of bottom panel 124 and a second attachment strip 132 may be welded to the back portion of top panel 122. A corrugated metal retention channel 134 may be welded near its bottom end to first attachment strip 130 and welded near its upper end to second attachment strip 132. Channel 134 provides structural rigidity to the back of metal case 20 and provides a means to attach a locking mechanism (not shown) to metal case 20. The locking mechanism which may be chosen from those well known in the art such as one manufactured by Engineered Security Products Corporation of Leominster, Mass. may be provided to lock drawers 100 in the closed position and prevent tipping of the case.

Figure 7:
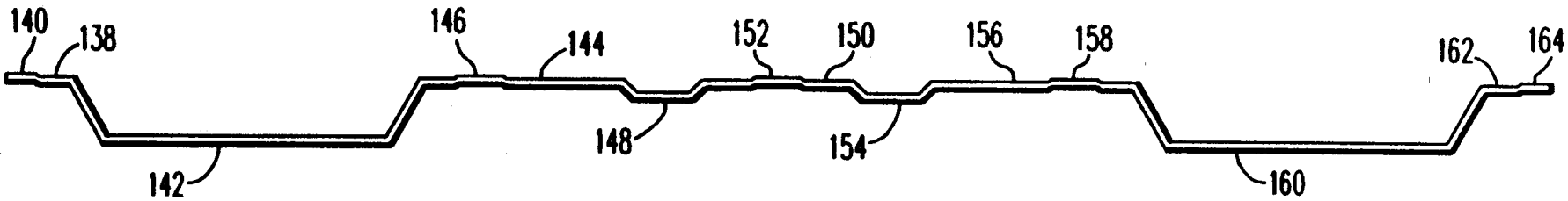
FIG. 7 is a top view of one of the side panels of the inner framework.
Figure 8:
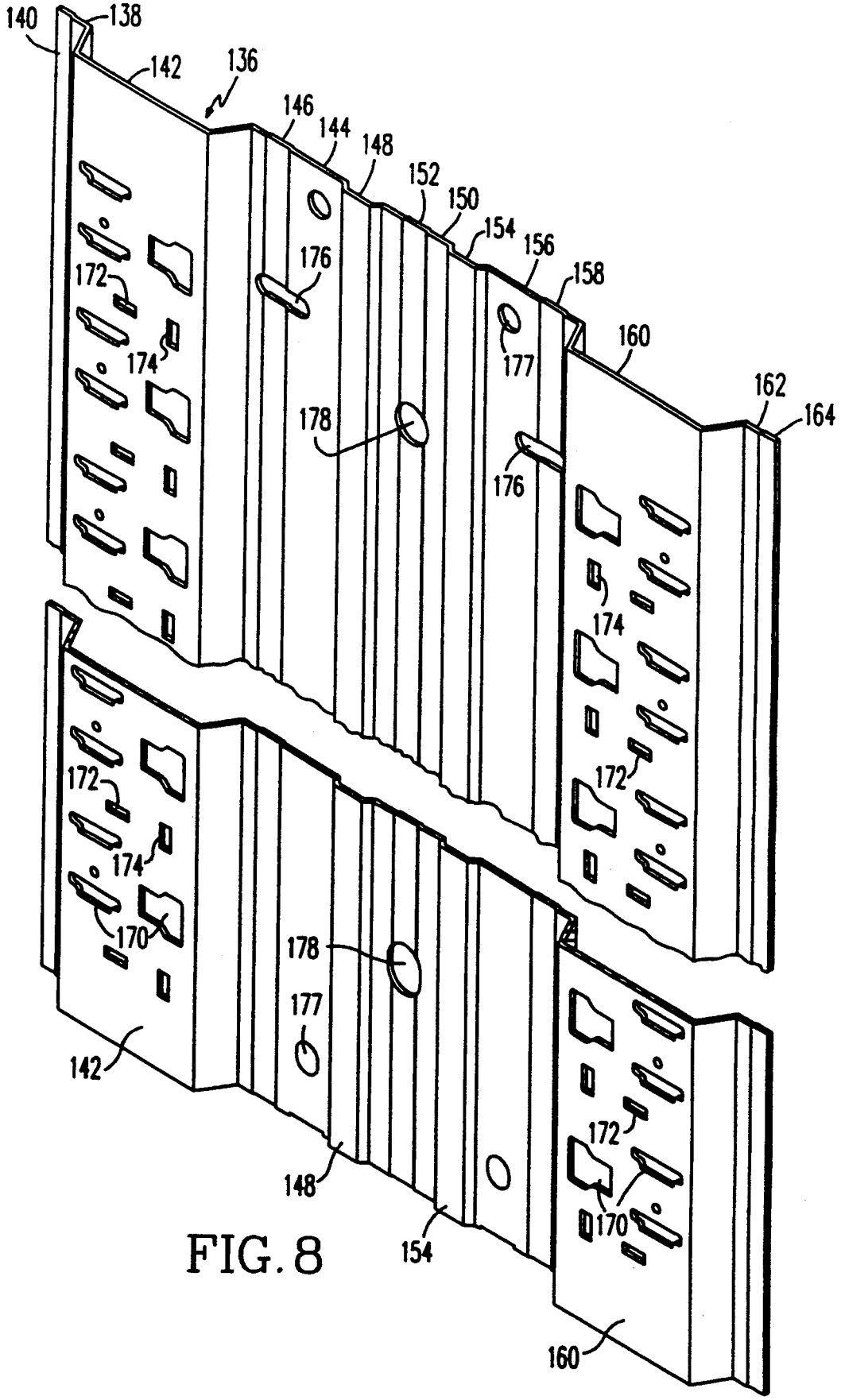
FIG. 8 is a perspective view of one of the side panels of the inner framework, in this instance, the right side panel.
Figure 8:
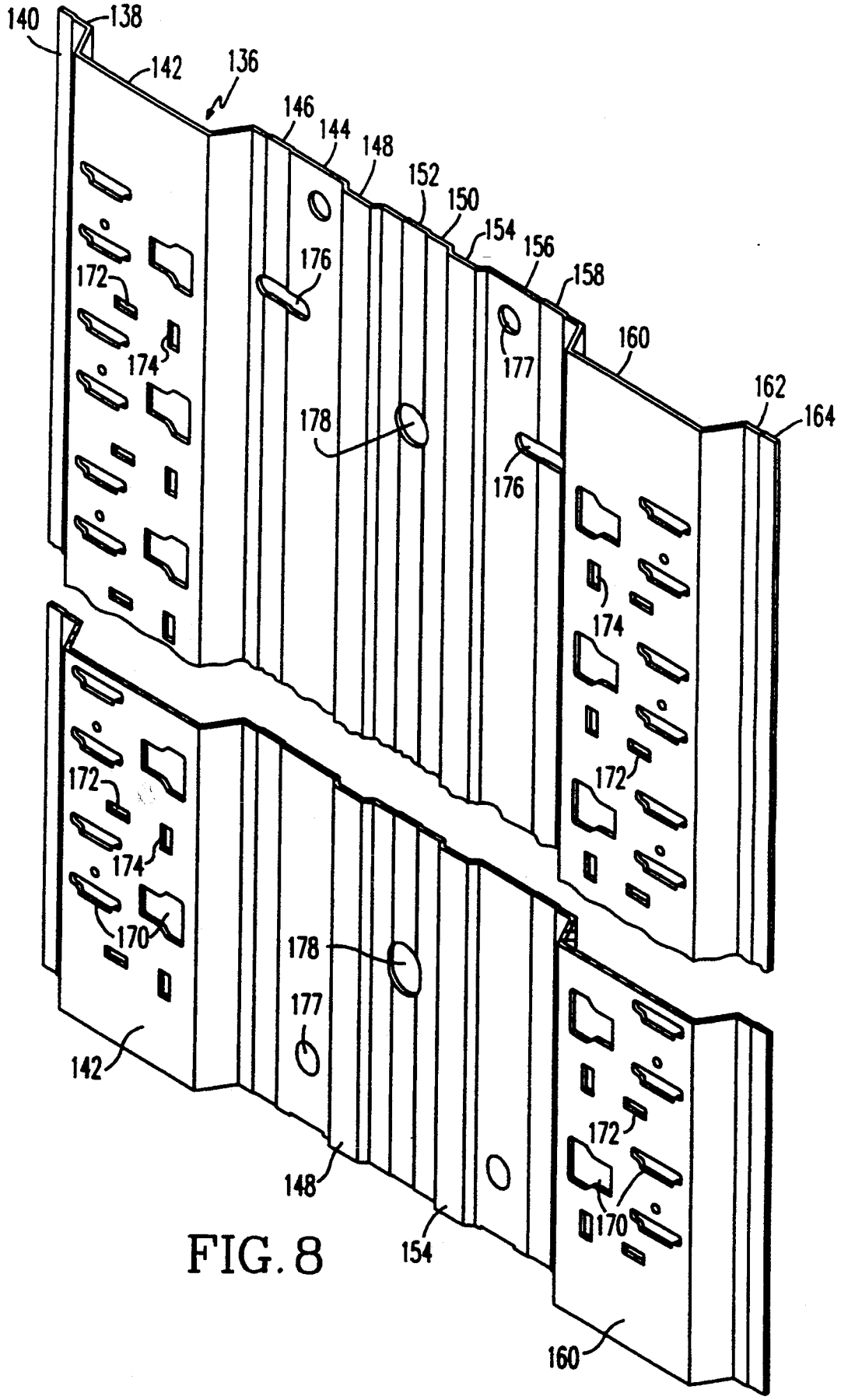

Referring now to FIGS. 6, 7 and 8 a typical edge 136 of a panel such as side panel 126 illustrates the general cross-sectional configuration of top panel 122, side panels 126 and each portion of bottom panel 124 which configuration extends substantially the entire length of the panel. The cross-section of a panel such as side panel 126 defines a first ridge 138 having a first land 140, an adjacent first trough 142, adjacent second ridge 144 having a second land 146, adjacent second trough 148, adjacent third ridge 150 with third land 152, adjacent third trough 154, adjacent fourth ridge 156 with fourth land 158, adjacent fourth trough 160 and adjacent fifth ridge 162 with fifth land 164. Lands 140, 146, 152, 158 and 164 may have a height of approximately 0.030 inches, troughs 142 and 160 may have a height of approximately 0.65 inches, and troughs 148 and 154 may have a height of approximately 0.14 inches. The combination of troughs and ridges provides structural rigidity to metal case 20 while allowing for the use of thinner less expensive metal members. Lands 140, 146, 152, 158 and 164 on side panels 126 provide metal to metal surface contact with wrapper 80. An adhesive such as a heat curable epoxy 954 available from Essex Specialty Products may be applied to ridges 138, 144, 150, 156 and 162. The adhesive tends to fill the space created between the ridges and the outer wrapper, while allowing substantial metal to metal contact between the lands and the outer wrapper. This adhesive provides a means to attach wrapper 80 to side panels 126 and enhances the sound deadening qualities of metal case 20. Ridges 138, 144, 150, 156, and 162 of top panel 122 also provide surface areas to which an adhesive such as a two part room temperature curable polyurethane adhesive 73010-A and 73010-B available from Essex Specialty Products may be applied. This adhesive provides a means to attach top pan 40 to top panel 122, to attach base pan 60 to bottom panel 124 and to secure the back expanse of wrapper 80 to the rear of channel 134 while enhancing sound deadening qualities. The use of adhesive in this manner greatly reduces the surface area affected by metal to metal rubbing and increases acoustical insulation.

As an alternative, lands 140, 146, 152, 158 and 160 may be replaced by dimples, which would not extend substantially the entire length of the panel.

As can be seen in FIGS. 3 and 9 top panel 122 has substantially the same cross-sectional configuration as side panels 126 except that troughs 142, 148, 154 and 160 of top panel 122 do not extend quite the length of top panel 122 so that the corresponding troughs of side panels 126 meet in a complimentary fashion. Likewise, ridges and lands of top panel 122 interconnect with the corresponding portion of side panels 126 to form a tight matching fit along adjoining edges where the panels may be welded together.

Again referring to FIG. 8, first trough 142 and fourth trough 160 have first openings 170 formed therein for attachment of drawer glides 102, and second openings 172 and third openings 174 formed therein for receding door locking clips (not shown). First openings 170, second openings 172 and third openings 174 thereby comprise a set which may be arranged in an orderly repeating fashion along first trough 142 and fourth trough 160. Each repeating set of openings may be formed in a simultaneous stamping to minimize tolerance stack-up. In addition, these openings are positioned in first trough 142 and fourth trough 160 in a generally symmetrical manner about the longitudinal center line of side panels 126. Because of this configuration, side panels 126 are interchangeable. That is, any side panel 126 may be used as a side panel on either side of metal case 20.

Top panel 122, bottom panel 124 and side panels 126 may also have fourth openings 176 therein for fabrication purposes during the roll forming process which trigger the simultaneous stamping of openings 170, 172 and 174. Additionally, top panel 122, bottom panel 124, and side panels 126 may include fifth openings 177 and sixth openings 178 for alignment and assembly purposes, so that the case may be properly constructed during mass production. It may be noted that top panel 122, the portions of bottom panel 124 and side panels 126 are basically of the same configuration and may be manufactured from the same material and process but with side panels 126 having additional openings.

Figure 10:
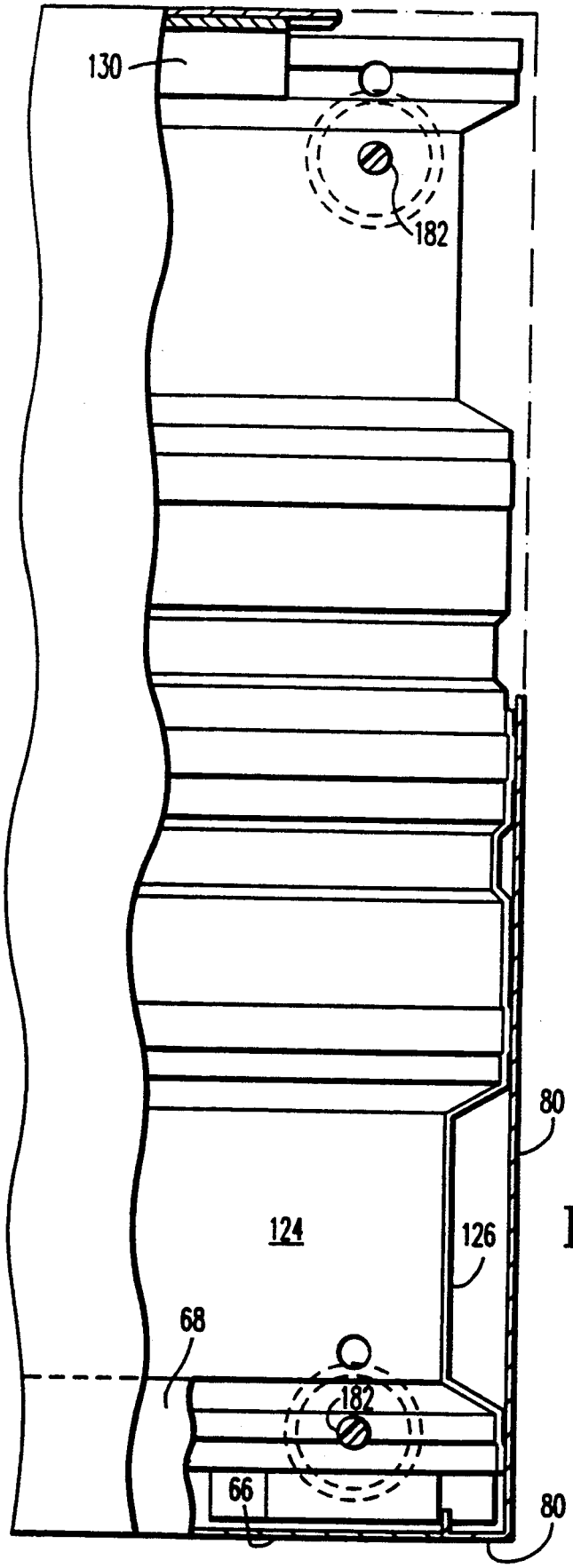
FIG. 10 is a top cross-sectional view of a bottom portion of the case.
Figure 11:
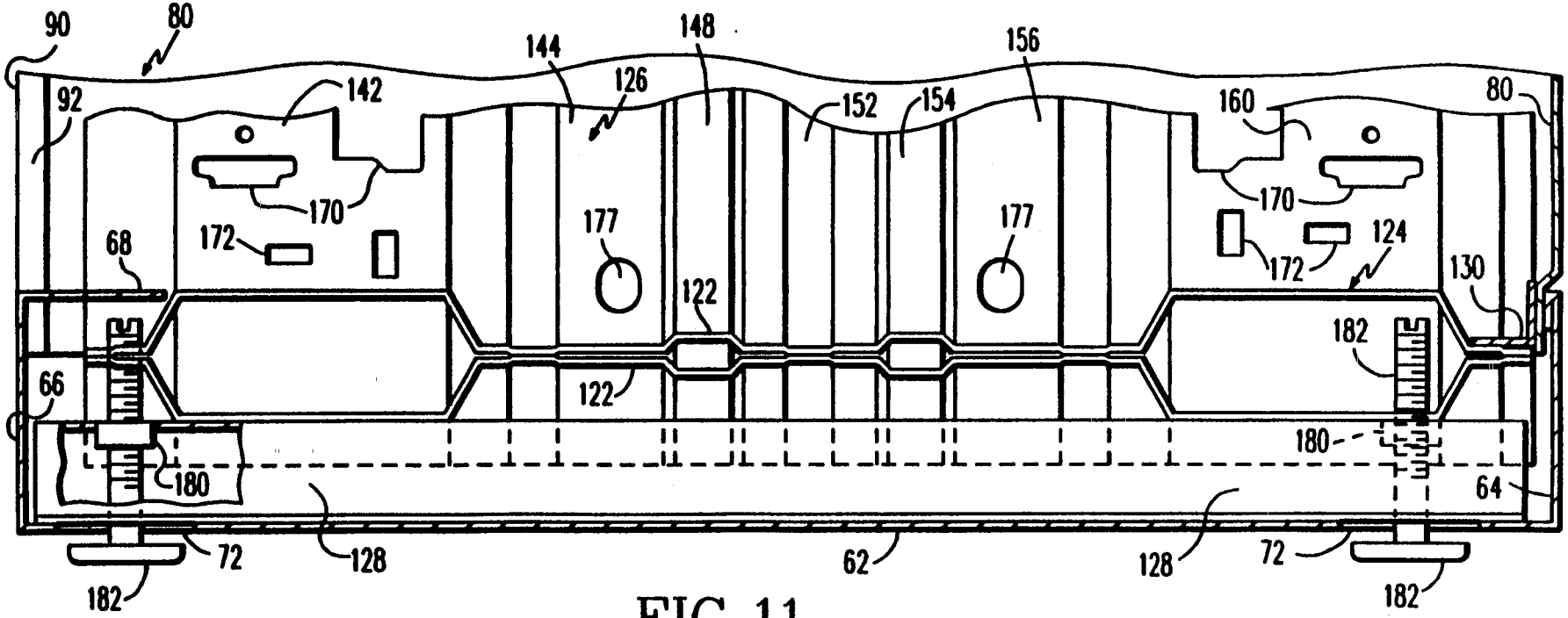
FIG. 11 is a cross-sectional view in elevation of the side of the bottom portion of the case.

Referring to FIGS. 10 and 11, bottom panel 124 may comprise two panels such as top panel 122 inverted and welded together as shown in cross-section in FIG. 11. In this manner, bottom panel 124 provides additional strength and height while utilizing panels having substantially the same cross-sectional configuration as side panels 126 and top panel 122.

Bottom panel 124 may be attached on its underside to rails 128 as shown in FIGS. 3, 10 and 11. Rails 128 function as feet for metal case 20 while supporting metal case 20 through bottom panel 124.

As may be seen in FIG. 10, bottom panel 124 is configured near each end similar to top panel 122 so that side panels 126 mate with bottom panel 124 and may be welded together at that intersection. This mating configuration may also be seen in FIG. 3.

Again referring to FIGS. 10 and 11, nuts 180 may be attached to rail 128 near each end so that threaded levelers 182 may be threadedly engaged therethrough. Levelers 182 are disposed within the channel of rail 128 and extend through apertures 72 of bottom 62 of base pan 60. Levelers 182 may be accessed and adjusted through the interior of metal case 20 so that metal case 20 may be leveled on its supporting surface such as a floor.

Figure 12:
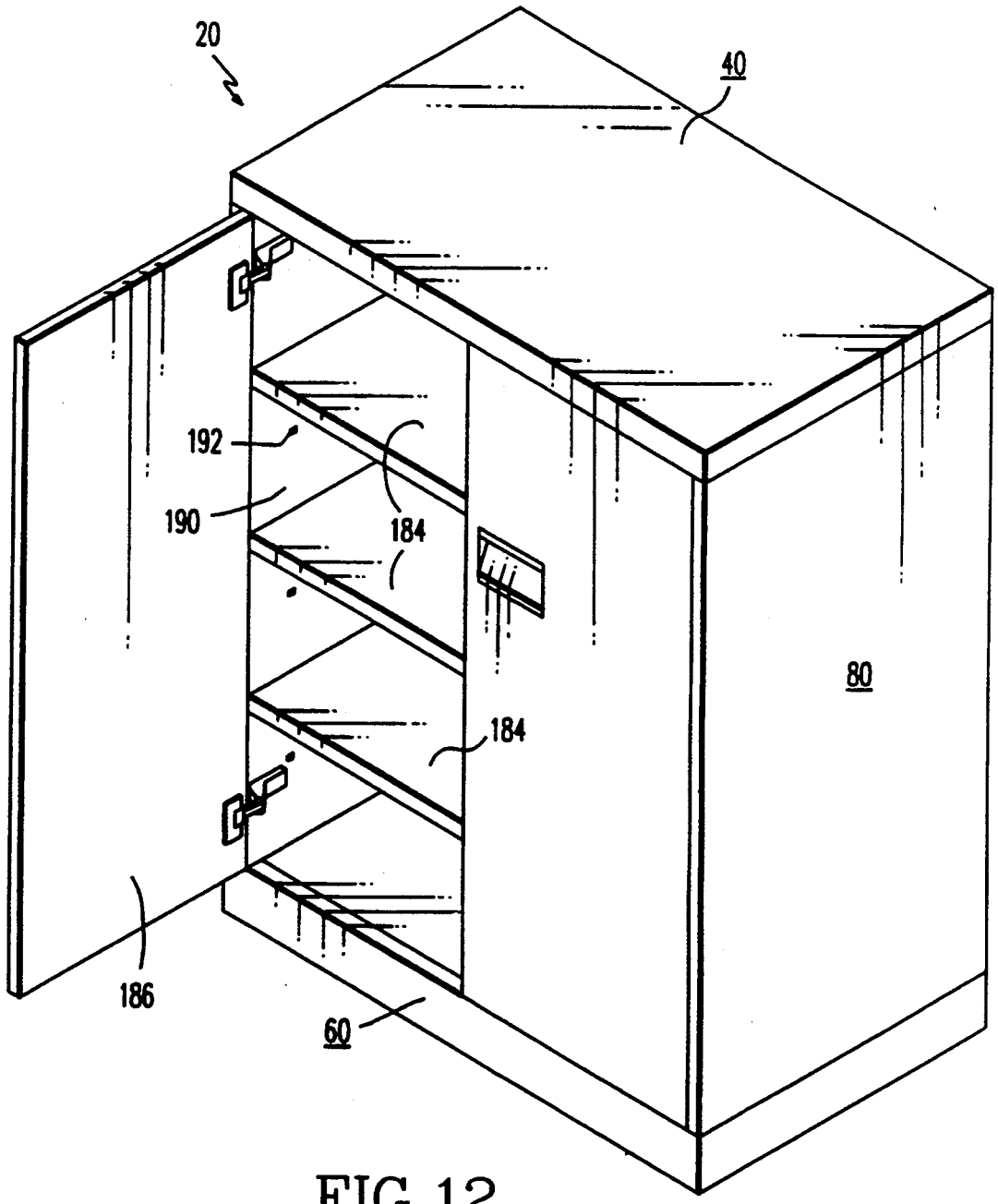
FIG. 12 is a perspective of a cabinet with shelves and doors.

FIG. 12 illustrates another embodiment of the metal case 20 being a cabinet with shelves 184 and doors 186. In this embodiment trim panels 190 are attached to the interior of the inner framework 120 thereby finishing its interior. Trim panels 190 may have ports 192 therein for attachment of shelves and hinges.

Figure 5:
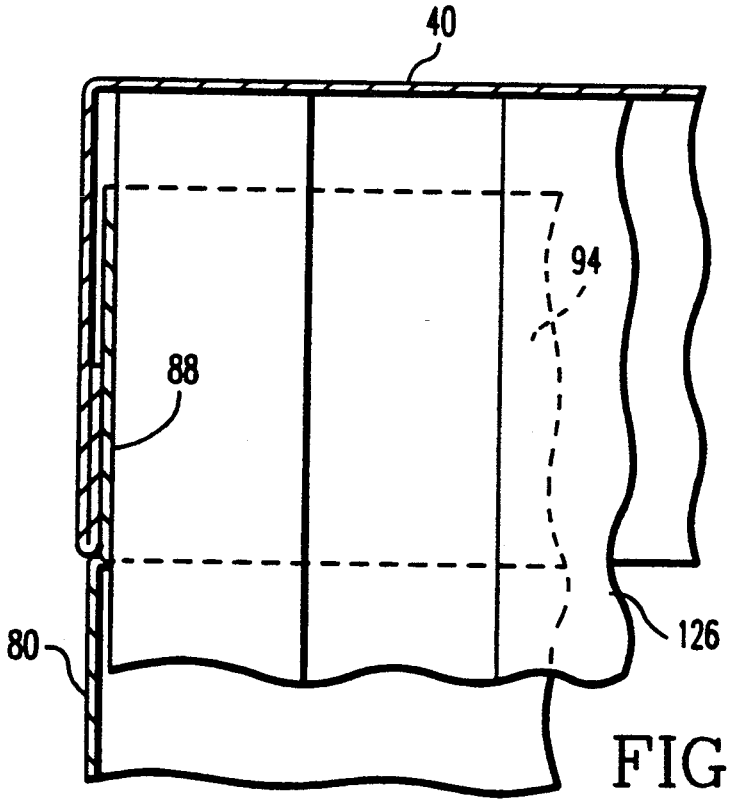
FIG. 5 is a cross-sectional view in elevation of a corner of the outer wrapper with the top pan attached.

In the assembly of metal case 20, top panel 122, bottom panel 124 and side panels 126 are welded together and rails 128 are attached to bottom panel 124 as shown in FIG. 3. Attachment strips 130 and 132 and channel. 134 may also be welded in place. Adhesive may then be applied to ridges 138, 144, 150, 156 and 162 of side panels 126. Then outer wrapper 80 may be carefully spread and disposed around inner framework 120 as depicted in FIGS. 2 and 3. Opening 95 may then be aligned with opening 177 of side panel 126 in order that the wrapper 80 may be properly aligned with the inner framework 120. When so arranged, outer wrapper 80 may be spot welded to inner framework 120 at points along upper ledge 94 and lower ledge 96. The assembly may then be heated to about 350° F. for approximately 20 minutes to cure the adhesive applied to side panels 126. Next, the air cured adhesive may be applied to ridges 138, 144, 150, 156 and 162 of top panel 122 and top pan 40 may then be placed on outer wrapper 80 as shown in FIGS. 1, 2 and 5. Of course, since top pan 40 has a lip or reveal, top pan 40 should be angled onto and over outer wrapper 80 and top panel 122. Similarly, the air cured adhesive may be applied to the bottom of the flanged ends of rails 128 and base pan 60 is then angled onto outer wrapper 80 and under bottom panel 124 and rails 128 so that inner lip or reveal 68 extends over bottom panel 124 as shown in FIG. 11. In this position, spaces 70 of bottom pan 60, which may also be located on the underside of top pan 40, may accommodate U-shaped bends 88 of wrapper 80. Before assembly, the outer corners of top pan 40 and base pan 60 may be plasma welded for greater strength and seamless design.

Once assembled as shown in FIG. 1 or FIG. 12, top pan 40 extends over upper ledge 94 and base pan 60 extends over lower ledge 96 thereby concealing the spot welds joining outer wrapper 80 to inner framework 120 thereby providing a double wall thickness of the entire top, sides and bottom of the case.

Thus, the use of the box-like inner framework comprised of metal corrugated panels, each having a similar cross sectional configuration and substantially extending the complete depth and length of the case, provides a stronger frame which does not rely on the outer wrapper for its structural integrity. This inner framework construction thereby allows for a reduction in material gauge thickness of steel used for manufacturing each of the metal corrugated panels and the outer wrapper thereby providing a more structurally sound and less expensively produced metal case, which is easily adaptable to varying height metal cabinets and lateral files.

Therefore, the invention provides a high quality metal cabinet and lateral file adaptable to various office settings and uses that are attractive, cost effective, sturdy and solid.

We claim:

1. A file cabinet having an inner framework comprising:

a plurality of vertically oriented corrugated metal side panels which extend substantially the depth of said cabinet;

a plurality of horizontally oriented corrugated metal panels which extend substantially the length of its corresponding side, wherein said horizontally oriented panels comprise a top panel and a bottom panel of said cabinet;

said corrugated top, bottom and side panels including ridges and troughs, said ridges located near the outer edge of each panel and said troughs located between said ridges wherein said troughs of said top and bottom panels complementarily mate with and are welded to said troughs of said side panels, thereby forming a box-like structure; and a substantially one-piece metal outer wrapper disposed around a portion of at least one of said side panels and an adjacent side.

2. The file cabinet according to claim 1 wherein said bottom panel further comprises two top panels oppositely positioned and welded together.

3. The metal file cabinet according to claim 1 wherein said side panels include equidistantly placed holes whereby hardware may be attached.

4. The file cabinet according to claim 3 wherein said equidistantly placed holes of said side panels are symmetrically arranged about a vertical centerline along said troughs thereby being symmetrically opposed between each side panel when said box-like structure is constructed.

5. The file cabinet according to claim 4 wherein said outer wrapper is attached to said side panels by adhesive, said being placed on one of said ridges of said side panels.

6. The file cabinet according to claim 5 wherein said outer wrapper includes top and bottom ledges, said top and bottom ledges of said outer wrapper being further attached to said side panels by spot welds located at the upper and lower portions of said side panels where said side panels complementarily mate with said top and bottom panels to form said box-shaped inner framework.

7. The file cabinet according to claim 6 wherein a top pan is placed over said top panel and said top ledge of said outer wrapper to conceal said spot welds.

8. The file cabinet according to claim 7 wherein a base pan is placed underneath and around said bottom panel and said bottom ledge of said outer wrapper to conceal said spot welds.

9. A file cabinet comprising:

a set of two vertically disposed side panels extending substantially the depth of said cabinet;

a horizontally disposed top panel extending substantially the depth of said cabinet and attached at its ends to the top ends of each of said side panels;

a horizontally disposed bottom panel extending substantially the depth of said cabinet and attached at its ends to the bottom ends of each of said side panels;

each of said panels having substantially the same cross-sectional configuration, with each of said panels having a plurality of corrugations therein for strengthening said cabinet; and a substantially one-piece metal outer wrapper which covers at least three vertical sides.

10. The file cabinet according to claim 9 wherein said top panel and said bottom panel are welded to said side panels to form a box-like structure.

11. The metal cabinet according to claim 9 wherein said panels include ridges and troughs, said ridges located near the outer edge of each panel and said troughs located between said ridges.

* * * * *